US011805585B2

(12) United States Patent
Vogels et al.

(10) Patent No.: US 11,805,585 B2
(45) Date of Patent: Oct. 31, 2023

(54) LIGHT EMITTING DIODE, LED, BASED LIGHTING DEVICE ARRANGED FOR EMITTING A PARTICULAR COLOR OF LIGHT, AS WELL AS A CORRESPONDING METHOD

(71) Applicant: SIGNIFY HOLDING B.V., Eindhoven (NL)

(72) Inventors: Lucas Louis Marie Vogels, Eindhoven (NL); Joris Hubertus Antonius Hagelaar, Eindhoven (NL); Berend Jan Willem Ter Weeme, Eindhoven (NL)

(73) Assignee: SIGNIFY HOLDING B.V., Eindhoven (NL)

( * ) Notice: Subject to any disclaimer, the term of this patent is extended or adjusted under 35 U.S.C. 154(b) by 0 days.

(21) Appl. No.: 17/775,329

(22) PCT Filed: Nov. 2, 2020

(86) PCT No.: PCT/EP2020/080678

§ 371 (c)(1),
(2) Date: May 9, 2022

(87) PCT Pub. No.: WO2021/094120

PCT Pub. Date: May 20, 2021

(65) Prior Publication Data

US 2022/0394829 A1 Dec. 8, 2022

(30) Foreign Application Priority Data

Nov. 12, 2019 (EP) ..... 19208695

(51) Int. Cl.

| | |
|---|---|
| ***H05B 45/24*** | (2020.01) |
| ***H05B 45/48*** | (2020.01) |
| ***H05B 45/28*** | (2020.01) |

(52) U.S. Cl.

CPC ..... *H05B 45/24* (2020.01); *H05B 45/28* (2020.01)

(58) Field of Classification Search

None

See application file for complete search history.

(56) References Cited

U.S. PATENT DOCUMENTS

2017/0188419 A1 6/2017 Gaertner et al.
2019/0373687 A1 * 12/2019 Williams ..... H05B 45/46

FOREIGN PATENT DOCUMENTS

DE 102017116647 A1 1/2019
WO 2017114146 A1 7/2017
WO WO-2017114146 A1 * 7/2017 ..... H05B 33/0815

* cited by examiner

*Primary Examiner* — Dedei K Hammond

(57) ABSTRACT

A Light Emitting Diode, LED, based lighting device arranged for emitting a particular color of light, wherein said LED based lighting device comprises a power supply unit arranged for providing a Direct Current, DC, bus voltage for powering LEDs, a plurality of parallel cascaded LED channels, wherein each of said LED channels is connected to said bus voltage and comprises at least one colored LED and a switch for activating said corresponding LED channel, a controller arranged for providing control signals to each of said switches in said LED channels for periodically activating said LED channels, wherein each of said control signals has a duty cycle, and wherein said controller is arranged for determining said duty cycles of said control signals based on a received color set point, wherein said controller is further arranged for determining an amount of deficiency in light output of each of said LED channels caused by parasitic effects in said LED based lighting device, by determining instantaneous currents of each channel and comparing said instantaneous currents with expected currents resulting from (Continued)

the determined duty cycles, and for increasing said duty cycles based on said determined amount of deficiency.

11 Claims, 3 Drawing Sheets

LIGHT EMITTING DIODE, LED, BASED LIGHTING DEVICE ARRANGED FOR EMITTING A PARTICULAR COLOR OF LIGHT, AS WELL AS A CORRESPONDING METHOD

CROSS-REFERENCE TO PRIOR APPLICATIONS

This application is the U.S. National Phase application under 35 U.S.C. § 371 of International Application No. PCT/EP2020/080678, filed on Nov. 2, 2020, which claims the benefit of European Patent Application No. 19208695.7, filed on Nov. 12, 2019. These applications are hereby incorporated by reference herein.

FIELD OF THE INVENTION

The present invention generally relates to the field of lighting and, more specifically, to a Light Emitting Diode, LED, based lighting device which is arranged to emit a particular color of light. The present invention further relates to a method of operating the LED based lighting device.

BACKGROUND OF THE INVENTION

Lighting devices have been developed that make use of Light Emitting Diodes, LEDs, for a variety of lighting applications. Owing to their long lifetime and high energy efficiency, LED lamps are nowadays also designed for replacing traditional fluorescent lamps, i.e. for retrofit applications. For such an application, a retrofit LED lamp is typically adapted to fit into the socket of the respective lamp fixture to be retrofitted. Moreover, since the maintenance of a lamp is typically conducted by a user, the retrofit LED lamp should ideally be readily operational with any type of suitable fixture without the need for re-wiring the fixture.

The present disclosure is related to multi-channel LED based lighting devices. Each channel may comprise a plurality of LED's that are capable of emitting light at a particular color. For example a first channel may be directed to emit red colored light. A second channel may be directed to emit green colored light and a third channel may be directed to emit blue colored light.

In such lighting devices, a fixed voltage source may be used to power the LEDs in each of the channels. The current through each of the channels may be set in the factory by tuning a resistor which is placed in series with the LEDs of a particular channel. One of the downsides of such an approach is related to several disturbing factors such as voltage variations of the power source, cable lengths, i.e. impedances, interactions between channels which may cause errors for the targeted flux and color point.

More specifically, typically, there is a controller to control a plurality of switches, wherein each of the switches is arranged to enable a particular channel. For example, a first switch may enable a red channel, a second switch may enable a green channel, a third switch may enable a blue channel, etc. The switches may be provided with Pulse Width Modulation, PWM, signals having particular duty cycles. The frequency of the PWM signals should be chosen such that it exceeds the refresh rates of the human eye. This would prevent a user from seeing any flickering. By controlling the duty cycle, the contribution of each of the channels to the total amount of light emitted can be controlled, and thus also the color of the light that is emitted by the LED based lighting device.

Often, a user may express, or input, the color that he/she wants the LED based lighting device to emit. As mentioned above, the inventors have found that many disturbing factors may exist which prevents the use of static duty cycles for each of the PWM signals fed to the switches.

SUMMARY

It would be advantageous to achieve a Light Emitting Diode, LED, based lighting device arranged for emitting a particular color of light. It would further be advantageous to achieve a corresponding method.

In a first aspect, there is provided a Light Emitting Diode, LED, based lighting device arranged for emitting a particular color of light. The LED based lighting device comprises:

a power supply unit arranged for providing a Direct Current, DC, bus voltage for powering LEDs;

a plurality of parallel cascaded LED channels, wherein each of said LED channels is connected to said bus voltage and comprises at least one colored LED and a switch for activating said corresponding LED channel;

a controller arranged for providing control signals to each of said switches in said LED channels for periodically activating said LED channels, wherein each of said control signals has a duty cycle, and wherein said controller is arranged for determining said duty cycles of said control signals based on a received color set point;

wherein said controller is further arranged for determining an amount of deficiency in light output of each of said LED channels caused by parasitic effects in said LED based lighting device, by determining instantaneous currents of each channel and comparing said instantaneous currents with expected currents resulting from the determined duty cycles, and for increasing said duty cycles based on said determined amount of deficiency.

The inventors have found that many parasitic components that may be present anywhere within the electrical circuit of the LED based lighting device may contribute, in a negative manner, to the accuracy of the light color emitted by the LED based lighting device. That is, the difference between the color set point and the actual colored light emitted by the LED based lighting device increases by increasing parasitic components.

The parasitic components may play a predominant role when multiple channels are active at the same time, such that a large current is drawn from the power supply. Typically, each of the LED channels are calibrated once when the LED based lighting device is manufactured. Such a calibration may take place in the factory. During the calibration, a single LED channel may be activated and calibrated. The calibration may thus not take into account activation of multiple channels at the same time.

For example, the bus series resistance, which may represent the resistance of the cable between the power supply unit and the actual LED based lighting device, may play a dominant role in the obtained error when multiple channels are activated at the same time. That is, a large current may cause a significant voltage drop over the bus series resistance thereby lowering the bus voltage. The DC bus voltage may become lower than expected.

The current through each channel may be set by a current resistor. The duty cycle set for a particular channel depends on the amount of current that is expected to flow through a particular channel. The amount of current may deviate from the expected current when the bus voltage is lower than expected, and thus also the voltage over the current resistor is lower than expected. This would lead to a reduced amount of current flowing through the channel when the corresponding switch is activated. The result is that the corresponding channel emits less light than what was actually expected. If a particular channel emits less light than expected, this may also result in a color shift in case of a system with multiple channels.

In accordance with the present disclosure, the above described situation is dealt with by increasing the duty cycle of the control signal to the corresponding switch.

In other words, next to the variations caused by the nominal bus voltage spread, also instantaneous voltage fluctuations may have a severe effect on the flux and color spread by the LED based lighting device. These voltage fluctuations are typically load dependent and may therefore act as function of the enabled LED channels. Within each period, typically 1 kHz, a combination of the plurality of channels can be active, all of these may have different on-times, causing various current plateaus.

When many channels are enabled, the load current is highest and hence the impact on the power supply unit is most severe which causes higher bus voltage fluctuations. Next to power supply behavior, also parasitic components such as the bus series resistance may cause a higher voltage drop the more current will be demanded from the power supply unit. The behavior of the power supply unit and the value of the parasitic components may be unknown to the controller. The controller may expect the measured values of the individual channels current, for example gathered during a startup or factory procedure, which are simply summed together the moment more channels are enabled. This may not be the case due to the impact of the bus voltage fluctuations and parasitic component losses. Therefore, these errors introduce color and flux deviations.

In accordance with the present disclosure, the controller is further arranged for determining an amount of deficiency in light output of each of said LED channels caused by parasitic effects in said LED based lighting device, by determining instantaneous currents of each channel and comparing said instantaneous currents with expected currents resulting from the determined duty cycles, and for increasing said duty cycles based on said determined amount of deficiency.

It is noted that, due to the parasitic effect in the LED based lighting device, a deficiency in light output in any of said LED channels occurs. Such a deficiency may have multiple effects. For example, the total luminance by the LED based lighting device may be reduced. Another option is that the color set point is shifted in case, for example, only one LED channel is affected by the parasitic effect.

In an example, the said controller is arranged for:

determining a measure related to said determined instantaneous currents of each channel multiplied by an ON-time of said corresponding duty cycle of each channel;

comparing said measure with an expected measure related to said determined instantaneous currents of each channel multiplied by an ON-time of said corresponding duty cycle of each channel;

determining, for each channel, the increase of duty cycle such that said determined measure will substantially equal said expected measure;

increasing, for each channel, said corresponding duty cycle.

The above described example is directed to the situation in which the controller intends to assure that the total amount of current flowing through a particular channel substantially equals the expected total amount of current.

For example, consider the situation in which the controller expects the current through a particular channel to be 35 mA during the ON-period of a Pulse Width Modulation, PWM, signal. However, due to all kinds of parasitic losses, the actual obtained current is not 35 mA, but, for example, 27 mA. The ON-period of the PWM signal is, for example, 1.9 ms. The controller thus expected to have 35 mA for 1.9 ms flowing through a particular channel. However, in reality, an amount of 27 mA was flowing for 1.9 ms. This effectively results in less illumination by the LED in the corresponding channel.

To compensate for the above, the inventors have realized that it may be difficult to increase the amount of current. This is caused by parasitic aspects that cause the bus voltage to drop, which, in its turn, causes the reduced amount of current. In order to combat the above, the inventors have found to increase the duty cycle, i.e. increase the ON-time of the control signal. In this example, the ON-time may be increased to about 2.4 ms such that the total amount of current through the respective channel is kept substantially the same.

In an example, the controller is arranged for determining said instantaneous currents by:

measuring voltages over sensing resistors comprised by any of said plurality of parallel cascaded LED channels.

As said above, the present disclosure is directed to the concept that a reduction in the instantaneous amount of current, caused by parasitic aspects, is to be compensated by increasing the duty cycle of the corresponding control signals. The reduction in the instantaneous amount of current may be determined in several manners. The present example determines the instantaneous amount of current by measuring a voltage over one or more sensing resistors comprised by the LED based lighting device, for example a sensing resistor in a supply line towards the plurality of LED channels, or in a return line from the plurality of LED channels. Another option is that a voltage is measured over sensing resistors present in the actual plurality of LED channels, for example the current set resistors.

In a further example, the controller is arranged for determining said instantaneous currents of each channel by:

measuring said currents flowing through said respective channels for at least two different DC bus voltages, and measuring said DC bus voltage and determining said respective currents flowing through said respective channels by interpolating said measurements for said at least two different DC bus voltages.

The controller may not be aware of the actual forward voltage drop of the LED's in a particular channel, and may thus also not be aware of a value of any resistor in the particular channel for setting the current that is to flow through the channel. The controller may, however, estimate, or interpolate, these aspects by measuring the currents flowing through the respective channels for at least two different DC bus voltages. This may, for example, be performed in the factory.

Using the obtained values, the current through a particular channel may be estimated by interpolating the measurements for the at least two different DC bus voltages. Following the above, during operation of the LED based lighting device, the controller may determine the instantaneous amount of current flowing through a particular channel by measuring the DC bus voltage.

In a further example, the controller is arranged for:

providing control signals to each of said switches in said LED channels for periodically activating said LED channels, wherein each of said control signals has a duty cycle, and wherein said controller is arranged for determining said duty cycles of said control signals based on a received color set point for a low lumen output, and scaling said low lumen output to a high lumen output by increasing said duty cycles based on said determined amount of deficiency.

In the above, the two references steps may be performed one after the other. That is, first the step of providing may be performed and, subsequently, the step of scaling may be performed. This is explained in more detail here below.

The controller may first determine the ratio of the duty cycles of each of the control signals for controlling each of the plurality of LED channels. The ratio of the control signals may be of importance for realizing the correct color set point. In this stage, the total lumen output of the LED based lighting device may be kept, intentionally, low. The goal here is to have a correct ratio between the different duty cycles of the control signals. The negative effects of the parasitic aspects are reduced by intentionally leaving the total amount of lumen output low.

The next step relates to scaling. That is, the total amount of lumen output is to be increased. The parasitic aspects, as explained above, may play a more dominant role in this step due to the increase in the total amount of current to be provided by the power supply unit.

The above entails that the duty cycles are increased to provide for the total amount of lumen output. However, the controller may thus also compensate each of the duty cycles individually, and thereby also the ratio between the duty cycles, based on the parasitic aspects. In this step, the controller may thus further be arranged for determining an amount of deficiency in light output of each of said LED channels caused by parasitic effects in said LED based lighting device, by determining instantaneous currents of each channel and comparing said instantaneous currents with expected currents resulting from the determined duty cycles, and for increasing said duty cycles based on said determined amount of deficiency.

In a further example, the LED based lighting device further comprises:

a memory comprising a relationship, for each channel, between bus voltages or currents flowing through said respective channel, and light intensity emitted by said at least one corresponding colored LED of said respective channel;

wherein said controller is further arranged for determining said DC bus voltage and/or said currents flowing through said respective channels and for controlling each of said LED channels for emitting said particular color of light taking into account said relationship.

It is noted that each of the LED channels may comprise a current control element for controlling the amount of current flowing to the respective channels, wherein the current control element controls the amount of current through the respective channels based on the DC bus voltage.

The current control element may be a tune resistor, for tuning the resistance value of the corresponding channel.

It was the insight of the inventors that the light intensity of a channel is related to the current that flows through that particular channel. A current control element is present for assuring that a predefined amount of current flows through the channel. The value of the current control element may, however, be determined based on a nominal, i.e. standard, DC bus voltage. Variations that occur in the DC bus voltage are then not taken into account. These variations may thus result in different light intensities of a particular channel.

It is further noted that the forward voltages of the LED's in each of the channels may differ. As such, red colored LED's may have different forward voltages compared to green colored LED's and compared to blue colored LED's. It is thus likely that the current control element is different for each of the channels, and it is thus likely that variations in the DC voltage bus will have different impact on each of the channels.

The inventors have found that it may be beneficial if the controller, i.e. the one that controls each of the channels, takes the above mentioned aspects into account. More specifically, the controller may use either the DC bus voltage to light intensity characteristics for each of the channels or the current flowing through the channel to light intensity characteristics for each of the channels, for compensating aspects.

That is, the controller may use the above described information for controlling each of the channels to a particular color of light.

In accordance with the present disclosure, the power supply unit may be arranged for receiving a mains input supply voltage, for example 230 Vac or anything alike, and may be arranged to convert that mains input supply voltage to a DC bus voltage for powering the LEDs in each of the channels.

In accordance with the present disclosure, the memory may be a Read Only Memory, ROM, Random Access Memory, RAM, a cache or anything alike.

In accordance with the present disclosure, the controller may, for example, be a microcontroller or any other control device such as a microprocessor, a field programmable gate array, FPGA, or anything alike. The microcontroller may, for example, receive the relevant input signals at some of the available input pins and may be provide output control signals at other available output pins.

It is noted that the memory may comprise a relationship, for each channel, between bus voltages or currents flowing through said respective channel, and light intensity emitted by said at least one corresponding colored LED of said respective channel. This is to be perceived broadly. Typically, the relationship is directed to the light outputted by a channel and the electrical characteristics of that channel. This may be expressed in several ways. For example, a bus voltage to current characteristic or anything alike. The relationship may thus also be provided indirectly as the current through a channel is indicative for the light emitted by that channel.

A colored LED is, in accordance with the present disclosure an LED that emits a particular color, for example white, blue, green, red, etc.

In an example, the controller is arranged for determining said currents flowing through said respective channels by:

measuring said DC bus voltage and calculating said currents by taking into account said measured DC bus voltage, nominal currents flowing through said channels and LED forward voltages of each of said LED's in the channels.

The controller may also be arranged for measuring the LED forward voltages of the LEDs present in the plurality of LED channels.

In a further example, the controller is further arranged for measuring an environmental temperature, and wherein said controller is arranged controlling each of said LED channels for emitting said particular color of light taking into account said relationship as well as said temperature.

In a second aspect of the present disclosure, there is provided a method of operating a Light Emitting Diode, LED, based lighting device in accordance with any of the previous examples. The method comprises the steps of:

providing, by said power supply unit, a DC bus voltage for powering LEDs;

providing, by said controller, control signals to each of said switches in said LED channels for periodically activating said LED channels, wherein each of said control signals has a duty cycle, and determining, by said controller, said duty cycles of said control signals based on said received color set point;

determining, by said controller, said amount of deficiency in light output of each of said LED channels caused by parasitic effects in said LED based lighting device, and increasing, by said controller, said duty cycles based on said determined amount of deficiency.

It is noted that the advantages and definitions as disclosed with respect to the embodiments of the first aspect of the invention also correspond to the embodiments of the second aspect of the invention, being the method for operating an LED based lighting device.

In an example, the method further comprises the steps of:

determining, by said controller, a measure related to said determined instantaneous currents of each channel multiplied by an ON-time of said corresponding duty cycle of each channel;

comparing, by said controller, said measure with an expected measure related to said determined instantaneous currents of each channel multiplied by an ON-time of said corresponding duty cycle of each channel;

determining, by said controller, for each channel, the increase of duty cycle such that said determined measure will substantially equal said expected measure;

increasing, by said controller, for each channel, said corresponding duty cycle.

In a third aspect, there is provided a computer readable medium having instructions stored thereon which, when executed by a controller of a LED based lighting device, cause said LED based lighting device to implement a method in accordance with any of the examples as provided above.

These and other aspects of the invention will be apparent from and elucidated with reference to the embodiment(s) described hereinafter.

DETAILED DESCRIPTION

Figure 1:
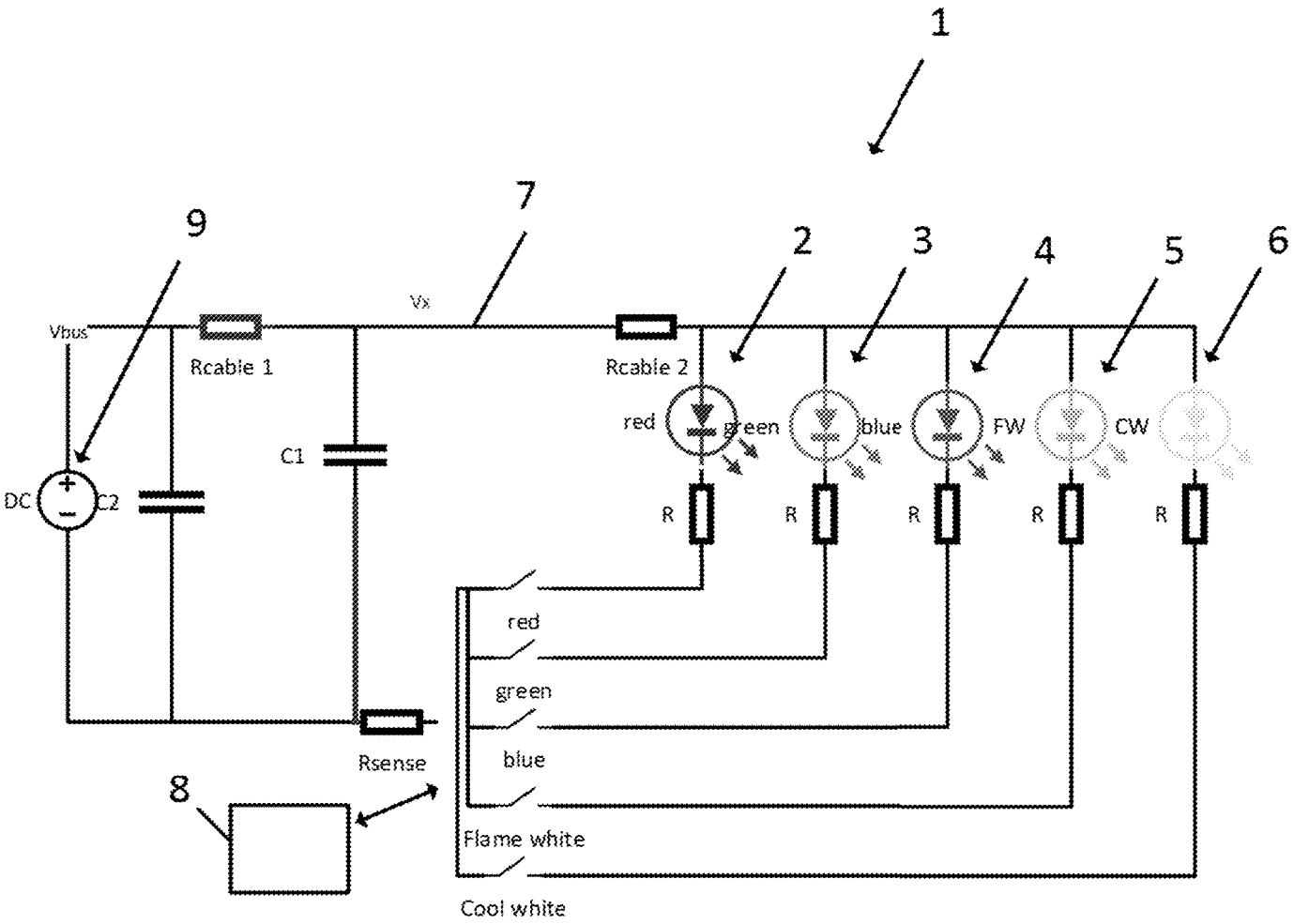
FIG. 1 shows an LED based lighting device in accordance with the prior art.

FIG. 1 shows an LED based lighting device 1 in accordance with the present disclosure.

Here, a power supply unit 9 is provided for generating the Direct Current, DC, bus voltage 7. The DC bus voltage 7 is typically about 24 Volts DC, but could range to any value. Usually, in order to prevent any hazardous situation, the DC bus voltage 7 is at least lower than about 50V DC. Electro-Magnetic Interference, EMI, filters may be placed close to the output of the power supply unit 9 for reducing any disturbances in the DC bus voltage 7.

In the present scenario, the LED based lighting device 1 comprises five channels as indicated with reference numerals 2, 3, 4, 5, 6. Each of the channels 2, 3, 4, 5, 6 is arranged for emitting light with a particular color. For example, the channel as indicated with reference numeral 2 is arranged for emitting red light, the channels as indicated with reference numeral 3 is arranged for emitting green light, the channel as indicated with reference numeral 4 is arranged for emitting blue light, the channel as indicated with reference numeral 5 is arranged for emitting flame white light and the channel as indicated with reference numeral 6 is arranged for emitting cool white light.

Each of the LED's of the different channels 2, 3, 4, 5, 6, may have different current requirements and may have different forward voltages. A forward voltage of a LED is defined as the voltage drop over that specific LED.

To accomplish that, each of the channels 2, 3, 4, 5, 6 is equipped with a current control element for tuning the current going through the channel. Suppose the DC bus voltage is nominally 24 VDC. The first channel, i.e. the one as indicated with reference numeral 2, may have six LED's each having a forward voltage of 3 VDC. This would accumulate to about 18 VDC voltage drop over the LED's. The remaining voltage, i.e. 24 VDC−18 VDC is 6 VDC is the voltage over the current control element. The resistor value may then be tuned to specify the current flowing through the channel.

A controller 8 may be present to control the channels 2, 3, 4, 5, 6. More specifically, the controller 8 may provide control signals to the corresponding switches of the channels 2, 3, 4, 5, 6, for either enabling or disabling the corresponding channels 2, 3, 4, 5, 6, for realizing a particular desired color of the total light emitted.

Typically, these control signals are Pulse Width Modulation, PWM, signals. The duty cycle of these PWM signals may be set by the controller for realizing that the LED based lighting device emits a particular colored light. The ratio between the duty cycles of the control signals determines the particular light color that is actually emitted.

The controller thus determines the duty cycles of each of the control signals. The controller is further arranged for determining an amount of deficiency in the light output of each of the LED channels caused by parasitic effects in the LED based lighting device, by determining instantaneous currents of each channel and comparing the instantaneous currents with expected currents resulting from the determined duty cycles, and for increasing the duty cycles based on the determined amount of deficiency.

The instantaneous currents may be determined in a variety of manners. For example, the Rsense resistor may be used for determining the total amount of current flowing through all the LED channels combined. Using, for example, multiple calibrated bus voltages, the total amount of current may be split into individual currents through the channels that are active at that moment.

Another option is that the voltages over each of the current control elements are measured, and that the current through a particular channel is determined by dividing the measured voltage by the resistance value of the corresponding current control element.

The controller may, for example determine a measure related to said determined instantaneous currents of each channel multiplied by an ON-time of said corresponding duty cycle of each channel, compare said measure with an expected measure related to said determined instantaneous currents of each channel multiplied by an ON-time of said corresponding duty cycle of each channel, determine, for each channel, the increase of duty cycle such that said determined measure will substantially equal said expected measure and increase, for each channel, said corresponding duty cycle.

It is noted that the parasitic aspects of the present disclosure may originate from the resistor as indicates with "Rcable1". The length of the cable between the power supply unit 9 and the plurality of LED channels 2, 3, 4, 5, 6 may be modelled as a resistor. Such a resistor contributes to a voltage drop such that the bus voltage 7 is lower than the expected bus voltage. This, in turn, leads to lower current through each of the LED channels 2, 3, 4, 5, 6.

Figure 2:
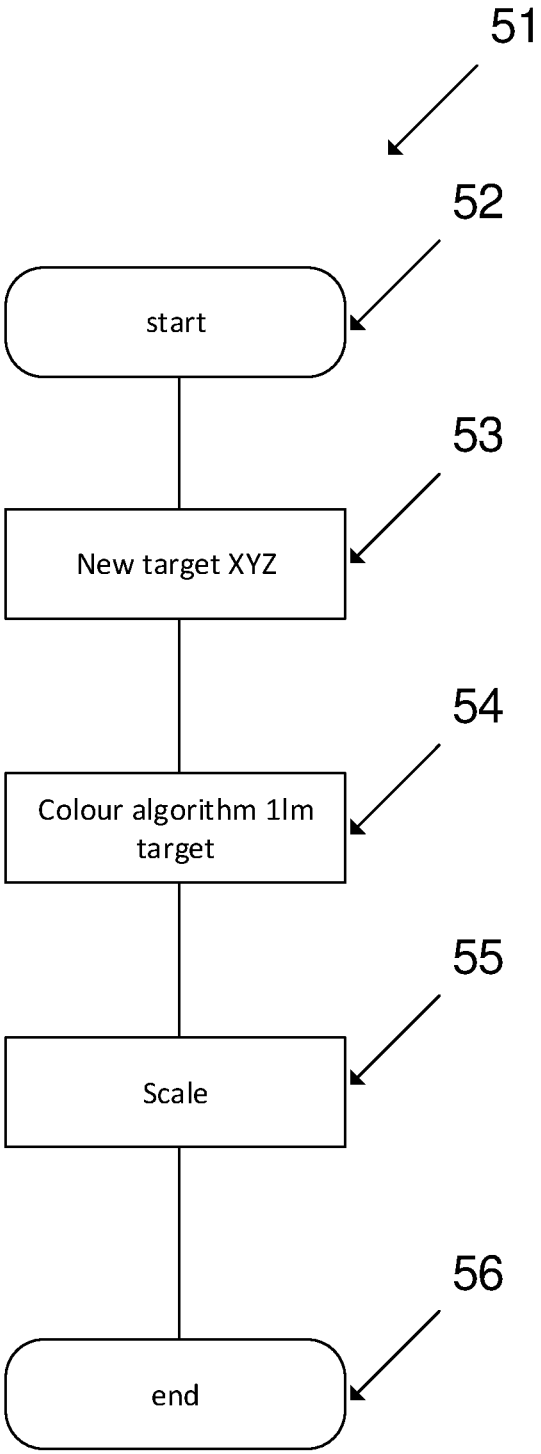
FIG. 2 shows a flow chart of a method in accordance with the present disclosure.

FIG. 2 shows a flow chart 51 of a method in accordance with the present disclosure.

The flow chart 51 starts 52 with obtaining a new target XYZ 53. The new target XYZ 53 indicates the desired color set point of the LED based lighting device. The desired color set point may relate to a particular temperature of the color, for example 4000K, or may relate to a particular RAL color or anything alike.

The desired color set point is provided to a color algorithm 54 which is executed by the controller. The color algorithm 54 uses the desired color set point for determining the duty cycles of each of the control signals to control the plurality of switches present in each of the plurality of LED channels.

In a first instance, the color algorithm 54 determines the ratio between the duty cycles, but assures that the total amount of lumen, i.e. the total amount of light, emitted by the LED based lighting device is relatively low, for example 1 lumen. As such, only the ratios between the duty cycles is calculated but not the intensity of the emitted light.

In a next step, the low lumen output is scaled to a high lumen output by increase each of the duty cycles accordingly and keeping the ratio between the duty cycles in mind. The ratio between the duty cycles may, however, change during this process due to the parasitic aspects as mentioned above.

During this process, the amount of deficiency in light output of each of the LED channels caused by parasitic effects in the LED based lighting device is determined by determining instantaneous currents of each channel and comparing said instantaneous currents with expected currents resulting from the determined duty cycles, and for increasing said duty cycles based on said determined amount of deficiency.

The inputs for the color algorithm may thus be the target color and brightness and may be the properties of the LEDs of the plurality of LED channels. These properties are the color point and flux per primary LED at the given drive current. These parameters could be compensated for the temperature increase due to self-heating of the lamps. Note that in the electronics architecture under discussion, it is the drive current through the LED strings that may vary as a result of fluctuations in the bus voltage.

In case of a voltage driven system, the target flux may be set to 1 lumen such that the duty cycle ratio between the different channels will be correct.

However, the brightness will thus be very low. That is the main reason why there is a post-processing step introduced that scales the duty cycles to higher values. The scale may be increased until either duty cycle is 100% or the power of the rated power of the power supply is reached to prevent over-powering of the power supply.

Figure 3:
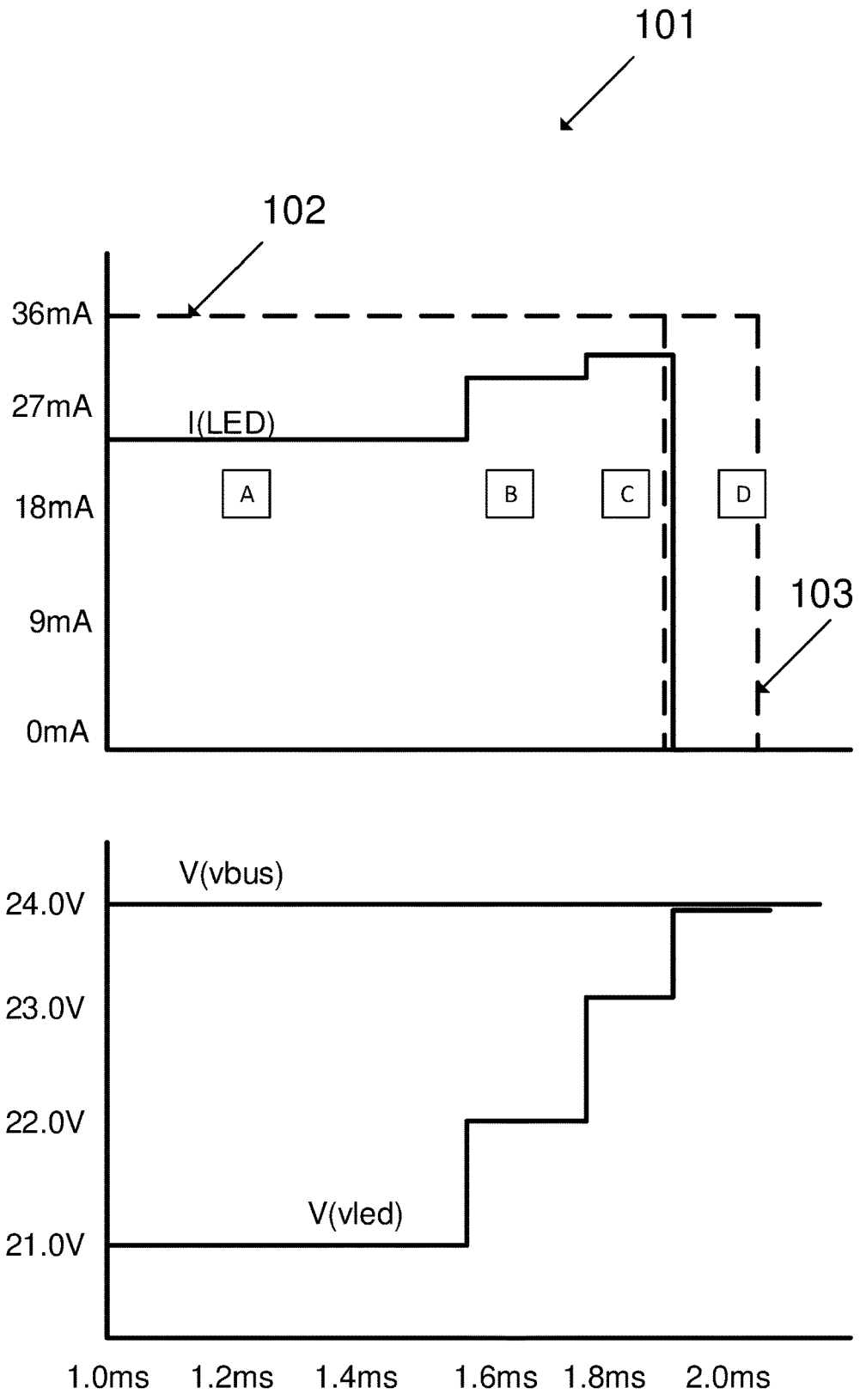
FIG. 3 shows a diagram illustrating the principles of the present disclosure.

FIG. 3 shows a diagram 101 illustrating the principles of the present disclosure.

The procedure is explained with an example having a dominant Rcable1.

The nominal bus voltage is 24V. At this voltage the depicted LED channel (one of the LED channels e.g. red green or blue), i.e. the line having the reference "I(LED)", should draw 36 mA if no dominant cable resistor Rcable1 was applied. A deviation from this ideal value can be seen in the graph; Three different phases can be distinguished:

Phase A. All three LED channels of the LED based lighting device are enabled. A high current flows through cable resistor Rcable 1 lowering the voltage over the LED channels, Vx, and reducing the current from its original designed value. In this example, the voltage over the LED channel is 21 V.

Phase B. Two channels are enabled. The load is reduced compared to phase A and hence there is less voltage drop over Rcable 1. Also there is therefore less impact and deviation from the original target, which is 36 mA. In this example, the voltage over the LED channel is 22 V.

Phase C. Single channel enabled—same principle as during phase A and phase B. In this example, the voltage over the LED channel is 23 V.

Phase D. No light output. The voltage over the LED channel should be equal to the bus voltage because the cable resistor Rcable1 does not cause any voltage drop as no current flows through Rcable1. Because there is no voltage drop over the cable resistor Rcable1, the voltage at the LED channel is 24 V.

The line indicated with reference numeral 102 indicates the Ideal current through the LED channel, i.e. this is what the controller expected if no compensation was applied.

The line indicated with reference numeral 103 is the required duty cycle to compensate for the loss of light caused by the dominant Rcable1. By measuring the current over time, which equals the total light output, and comparing it to the original target, i.e. current*time of original dashed curve 102, the loss of light output may be determined and compensated by increasing the duty cycle of the corresponding PWM control signal.

When the current through the LED channels is measured as shown in FIG. 1, a single sense resistor Rsense is used to sense the current that flows through all the LED channels. It is therefore not possible to determine the current flowing through a single LED channel when multiple LED channels are conducting current. The current flowing through a single LED channel e.g. the channel with the red LED, can be measured when only that single LED channel is conducting current. However, even when this single current can be measured, the current flowing through this single, red, LED channel will not be the same when multiple LED channels e.g. red and blue, are conducting current because the total amount of current causes an increase in voltage drop over the cable resistor Rcable1. This causes the bus voltage to drop at the LED channels and therefore the current through the red LED channel will be lower than the current that was measured. It is an insight of the inventors that the current through an LED channel is not only impacted by the voltage drop caused by the current flowing through the LED channel, but also by the additional LED channels that are active at the same time. This can be observed in FIG. 3 as the change in the LED channel voltage Vx when more or less LED channels are active at the same time. Therefore, the controller can be arranged to detect the LED channel voltage Vx at different moments in time when different number of LED channels are conducting current. This allows the controller to relate the voltage drop of the LED channel voltage Vx to the drop of current in each of the LED channels based on the number of channels conducting current at a single moment in time. This relation allows an additional correction of the duty cycles for each of the LED channels.

Other variations to the disclosed embodiments can be understood and effected by those skilled in the art in practicing the claimed invention, from a study of the drawings, the disclosure, and the appended claims, In the claims, the word "Comprising" does not exclude other elements or steps, and the indefinite article "a" or "an" does not exclude a plurality. A single processor or other unit may fulfil the functions of several items recited in the claims. The mere fact that certain measures are recited in mutually different dependent claims does not indicate that a combination of these measures cannot be used to advantage. A computer program may be stored/distributed on a suitable medium, such as an optical storage medium or a solid-state medium supplied together with or as part of other hardware, but may also be distributed in other forms, such as via the Internet or other wired or wireless telecommunication systems. Any reference signs in the claims should not be construed as limiting the scope thereof.

The invention claimed is:

1. A Light Emitting Diode (LED) based lighting device arranged for emitting a particular color of light, wherein said LED based lighting device comprises:

a power supply unit arranged for providing a Direct Current (DC) bus voltage for powering LEDs;

a plurality of parallel cascaded LED channels, wherein each of said LED channels is connected to said bus voltage and comprises at least one colored LED and a switch for activating said corresponding LED channel;

a controller arranged for providing control signals to each of said switches in said LED channels for periodically activating said LED channels, wherein each of said control signals has a duty cycle, and wherein said controller is arranged for determining said duty cycles of said control signals based on a received color set point; and a memory comprising a relationship, for each channel, between:

bus voltages or currents flowing through said respective channel, and light intensity emitted by said at least one corresponding colored LED of said respective channel; and a single sense resistor for determining a total amount of current flowing through all the LED channels;

wherein said controller is further arranged for:

determining said DC bus voltage and/or said currents flowing through said respective channels;

controlling each of said LED channels for emitting said particular color of light; and determining an amount of deficiency in light output of any of said LED channels caused by parasitic effects, originating from a cable resistor between the power supply and the LED channels, by measuring instantaneous currents of said any of said channels and comparing said instantaneous currents with expected currents resulting from the determined duty cycles, and for increasing said corresponding duty cycles based on said determined amount of deficiency.

2. The LED based lighting device in accordance with claim 1, wherein said controller is arranged for:

determining a measure related to said determined instantaneous currents of each channel multiplied by an ON-time of said corresponding duty cycle of each channel;

comparing said measure with an expected measure related to said determined instantaneous currents of each channel multiplied by an ON-time of said corresponding duty cycle of each channel;

determining, for each channel, the increase of duty cycle such that said determined measure will substantially equal said expected measure;

increasing, for each channel, said corresponding duty cycle.

3. The LED based lighting device in accordance with claim 1, wherein said controller is arranged for determining said instantaneous currents by:

measuring voltages over sensing resistors connected to any of said plurality of parallel cascaded LED channels.

4. The LED based lighting device in accordance with claim 1, wherein said controller is arranged for determining said instantaneous currents of each channel by:

measuring said currents flowing through said respective channels for at least two different DC bus voltages, and measuring said DC bus voltage and determining said respective currents flowing through said respective channels by interpolating said measurements for said at least two different DC bus voltages.

5. The LED based lighting device in accordance with claim 1, wherein said controller is arranged for:

providing control signals to each of said switches in said LED channels for periodically activating said LED channels, wherein each of said control signals has a duty cycle, and wherein said controller is arranged for determining said duty cycles of said control signals based on a received color set point for a low lumen output, and scaling said low lumen output to a high lumen output by increasing said duty cycles based on said determined amount of deficiency.

6. The LED based lighting device in accordance with claim 1, wherein said controller is arranged for determining said currents flowing through said respective channels by:

measuring said DC bus voltage and calculating said currents based on said measured DC bus voltage, nominal currents flowing through said channels and LED forward voltages of each of said LED's in the channels.

7. The LED based lighting device in accordance with claim 6, wherein said controller is further arranged for measuring said LED forward voltages.

8. The LED based lighting device in accordance with claim 1, wherein said controller is further arranged for measuring an environmental temperature, and wherein said controller is arranged controlling each of said LED channels for emitting said particular color of light based on said temperature.

9. A method of operating a Light Emitting Diode (LED) based lighting device comprising:

providing, by a power supply unit, a DC bus voltage for powering LEDs, wherein the lighting device comprises a plurality of parallel cascaded LED channels, and wherein each of said LED channels is connected to said bus voltage and comprises at least one colored LED and a switch for activating said corresponding LED channel;

providing, by a controller, control signals to each of said switches in said LED channels for periodically activating said LED channels, wherein each of said control signals has a duty cycle, and determining, by said controller, said duty cycles of said control signals based on a received color set point;

determining, by said controller, an amount of deficiency in light output of each of said LED channels caused by parasitic effects in said LED based lighting device, and increasing, by said controller, said duty cycles based on said determined amount of deficiency.

10. The method in accordance with claim 9, wherein said method further comprises the steps of:

determining, by said controller, a measure related to said determined instantaneous currents of each channel multiplied by an ON-time of said corresponding duty cycle of each channel;

comparing, by said controller, said measure with an expected measure related to said determined instantaneous currents of each channel multiplied by an ON-time of said corresponding duty cycle of each channel;

determining, by said controller, for each channel, the increase of duty cycle such that said determined measure will substantially equal said expected measure; and increasing, by said controller, for each channel, said corresponding duty cycle.

11. A non-transitory computer readable medium having instructions stored thereon which, when executed by a controller of a LED based lighting device, cause said LED based lighting device to perform the method of claim 9.

* * * * *